United States Patent [19]

Kutta

[11] 4,400,176

[45] Aug. 23, 1983

[54] PROCESS FOR REDUCING THE WATER CONTENT OF COAL CONTAINING BOUND WATER

[75] Inventor: Helmuth W. Kutta, Richardson, Tex.

[73] Assignee: Atlantic Richfield Company, Los Angeles, Calif.

[21] Appl. No.: 371,624

[22] Filed: Apr. 26, 1982

[51] Int. Cl.[3] ..... C10L 9/02

[52] U.S. Cl. ..... 44/1 R; 44/1 G; 44/6

[58] Field of Search ..... 44/1 R, 1 G, 6

[56] References Cited

U.S. PATENT DOCUMENTS 1,748,335 2/1930 Farley et al. ..... 44/6
2,922,705 1/1960 Dohmen ..... 44/24

FOREIGN PATENT DOCUMENTS 32607 6/1970 Australia ..... 44/1 G
448299 6/1936 United Kingdom ..... 44/6

*Primary Examiner*—Carl F. Dees
*Attorney, Agent, or Firm*—F. Lindsey Scott

[57] ABSTRACT

An improved process for reducing the water content of coal containing bound water by releasing at least a portion of the bound water by maintaining the coal at a temperature from about 220° to about 500° F. in the presence of water at a pressure sufficient to maintain at least a portion of the water in a liquid phase for a time sufficient to release at least a portion of the bound water wherein the improvement comprises contacting the coal during such treatment with an acidic material selected from the group consisting of carboxylic organic acids containing up to about 6 carbon atoms, phenol, phenolic acids and inorganic acids.

10 Claims, No Drawings

PROCESS FOR REDUCING THE WATER CONTENT OF COAL CONTAINING BOUND WATER

This invention relates to processes for reducing the water content of coal containing bound water.

This invention further relates to processes for reducing the water content of coal containing bound water by maintaining such coal at an elevated temperature and pressure for a period of time sufficient to result in the release of at least a portion of the bound water.

This invention further relates to an improvement in processes for reducing the water content of coal containing bound water by maintaining the coal at elevated temperature and pressure for a period of time sufficient to result in the release of at least a portion of the bound water wherein the improvement comprises contacting the coal with an acidic material selected from the group consisting of carboxylic organic acids, phenol, phenolic acids and inorganic acids during such treatment.

In recent years, as a result of the well known energy shortage, increased attention has been directed to the production of coal of varying grades for use as a fuel as a substitute for petroleum-derived products. Considerable attention has been directed to the production of lower rank coals for use as a fuel since such coals typically are relatively low in ash and surfur. Further, such coals can be produced from many deposits at a low cost relative to other coals. A primary disadvantage associated with the use of such low rank coals, i.e. such coals as brown coal, lignite and sub-bituminous coal has been that the coals as mined typically contain relatively high amounts of water. For instance, brown coal typically contains up to about 70 weight percent water with water contents from about 50 to about 70 weight percent being common. Lignite may contain up to as much as about 60 weight percent water with water contents of about 40 to about 60 weight percent being common. Sub-bituminous coal typically contains from about 30 to about 50 weight percent water. Since many of these deposits are located at substantial distances from the locations at which the fuels are to be consumed, the transportation of the water alone represents a significant expense in the production and use of such coals. Further, the water content of the coal results in a relatively low heat content per unit weight. In other words, the heat value realized upon burning a given weight of the wet coal is much lower than would be the heat value recovered upon burning a comparable weight of dried coal. Since the heat value recovered per unit of weight is a criteria for use in many existing boiler installations, drying the coal renders it suitable for use in a larger number of existing installations than would be the case were the wet coal shipped. For these and a variety of other reasons, it is desired that the moisture content of lower rank coals as produced be reduced.

The water contained in coal may be present in different forms. For instance, in higher rank coals such as bituminous and anthracite coal, little of the water associated with the coal is present as chemically bound water or interstitial water. Rather the water present is normally surface water and is readily removed upon drying, even at relatively low temperatures for relatively short periods of time. By contrast the water present in brown coal and lignite coal may be present as colloidal water, occlusion water, capillary water, chemically bound water or the like. Such water is not readily removed by short drying periods or low temperatures. Rather it is necessary that the entire body of the coal particles be heated and held at the elevated temperature for a period of time sufficient to remove the water by evaporation. Further it may be necessary in some instances to break chemical bonds to separate portions of the water from such coal. As a result, such drying processes are relatively expensive and more economical alternatives have been sought.

One alternative process involves the treatment of such lower rank coals by subjecting the coal to high temperature and high pressure treatment for a period of time sufficient to release at least a portion of the bound water from the coal. Such processes are known to the art and are disclosed and discussed in many of the patents listed below. The patents listed below were considered in the preparation of the present application.

| Pat. No. | Inventor |
|---|---|
| 4,192,650 | Seitzer |
| 4,080,176 | Verschuur |
| 4,052,168 | Koppelman |
| 4,014,104 | Murphy |
| 3,992,784 | Verschuur et al. |
| 3,552,031 | Evans et al. |
| 3,007,254 | Schuster |
| 2,966,400 | Lykken |
| 2,668,099 | Cederquist |
| 2,610,115 | Lykken |
| 1,965,513 | Ruzicka |
| 1,632,829 | Fleissner |
| 1,679,078 | Fleissner |

While these references are not considered to show or suggest the invention discussed herein, they are considered to be illustrative of the state of the art and are hereby incorporated in their entirety by reference.

It has now been found that an improvement is accomplished in the practice of such processes by the use of an additive in the coal contacting zone selected from the group consisting of carboxylic organic acids containing up to about 6 carbon atoms, phenol, phenolic acids and inorganic acids.

In the practice of such processes the coal is typically charged to a contacting zone along with water in an amount sufficient to provide a saturated steam atmosphere in the contacting zone while still retaining a portion of the water in a liquid phase and thereafter heated to a temperature from about 220° to about 500° F. (100° to 260° C.) at a steam pressure corresponding to the water temperature. The pressure is normally maintained at a level sufficient to result in liquid water being present in the contact zero. Reaction times up to about 160 minutes are common, although longer times or shorter times could be used depending upon the particular coal and the amount of bound water to be released. The amount of bound water to be released can vary widely and will be a function of the treating temperature, the reaction time used and the like. Normally, at least one-third of the bound water is released in the practice of such processes.

In the practice of the improvement of the present invention, an acidic material is added to the contact zone for intimate contact with the coal during the treatment. The material added is selected from the group consisting of mono-, di- and tricarboxylic organic acids containing up to about 6 carbon atoms, phenol, phenolic acids and inorganic acids. It is believed that substantially any carboxylic organic acid will be suitable so long as it is reasonably soluble in water at the reaction temperature and conditions so that intimate contact with the coal can be accomplished. Some preferred organic acids are formic acid, acetic acid, oxalic acid and citric acid. Phenol and phenolic acids are also suitable. Some suitable phenolic acids are phenolic disulfonic acids, salicylic acid, resorcinol, pyrogallol, mono and di sulfonic acids of phenols, hydroxy benzoic acids, polyhydric phenols and the like, although phenol is preferred. Preferred inorganic acids are hydrochloric acid, sulfuric acid and phosphoric acid, with phosphoric acid being preferred.

The acidic material may be added in varying quantities dependent upon the amount of water removal sought. In general it is believed that at least 10 weight percent acidic material will be used based upon the weight of the wet coal charged to the process. Clearly, additional quantities of acidic material can be used.

It has been found that the use of the acidic material results in the removal of substantially increased amounts of bound water by comparison to the amount of bound water removed at comparable reaction conditions without the acidic material present. Desirably the coal charged to the contact zone is maintained above or otherwise out of contact with the liquid water, although such is not necessary in the practice of the process. In either event, the acidic material is desirably added with the water.

It has been found that nonacidic materials tested did not result in a similar increase in the amounts of bound water removed.

Upon completion of the treatment of the coal, the water including that initially added and the bound water released can be physically separated from the coal by draining or the like with the coal being recovered as a solid product and the water being recovered for use as a recycle or the like. Desirably, the acidic material used is recovered from the water stream to the extent necessary to recycle the acidic material to the reaction zone. Since a variety of acidic materials are suitable, a variety of recovery methods can be used. It is believed that methods for recovering acidic materials from aqueous streams are sufficiently well known to the art that there is no need to discuss such methods in detail.

With certain of the acidic materials, particularly phenol, it has been observed that the coal is apparently deactivated to at least some extent with respect to its tendency to undergo spontaneous combustion after de-watering. It is well known to those skilled in the art that lower rank coals, after drying, tend to spontaneously ignite upon storage, transportation or the like. Accordingly, the reduction of the tendency of the coal to undergo spontaneous ignition and combustion is highly desirable. Further, it appears that other of the acidic materials, particularly phosphoric acid, have resulted in a substantial reduction in the ash content of the dewatered coal. Such is also desirable, since the ash content of the coal is one criteria considered in determining its market value and the uses for which it is suitable.

Having thus described the invention by reference to certain of its preferred embodiments, it is respectfully pointed out that the embodiments described are illustrative rather than limiting in nature and that many variations and modifications are possible within the scope of the present invention. It is contemplated that many such variations and modifications may be considered obvious and desirable by those skilled in the art based upon a review of the foregoing description of preferred embodiments and the following examples.

EXAMPLE

A variety of tests were run using different acidic materials by charging a weighed quantity of coal, water in an amount sufficient to maintain liquid water in the reaction vessel at the treatment temperature and a measured quantity of acidic material to a reaction vessel. The reaction zone was then heated to the desired contact temperature and maintained at that temperature for a selected time. The coal initially charged to the reaction vessel contained about 61 weight percent water and was suspended in a wire mesh basket above the liquid level in reaction vessel. At the conclusion of the tests, the water was drained from the vessel and the coal was removed from the vessel and weighed, with the water content of the product coal then being determined. A plurality of tests were run as shown below in Table 1. The acidic materials tested are listed in the table column headed "Additive", with the amount of acidic material used being shown as a weight percent based on the amount of wet coal charged to the reaction vessel. The contact times and temperatures are shown for each test. The product coal water content is shown as a weight percent of the product coal. The column headed "Comparable Product Coal Water With No Additive" refers to the amount of water present in a comparable coal product produced at the contact temperature and time with no additive present. The water content reduction is shown as a percent indicating the improved water content reduction by comparison to the comparable product with no additive.

Some nonacidic materials were tested, i.e. formaldehyde, ammonia, carbon dioxide, pyridine and toluene. These materials either resulted in a very slight or no improvement or less release of bound water than with no additive at all.

TABLE 1

| Additive | Amount (Wt. %) | Contact Temp (°F.) | Contact Time (Min) | Product Coal Water (Wt. %) | Comparable Product Coal Water With No Additive (Wt. %) | Water Content Reduction (%) |
|---|---|---|---|---|---|---|
| None | — | 438 | 160 | 43 | 43 | |
| None | — | 478 | 160 | 33 | 33 | |
| Phenol | 37.5 | 438 | 160 | 34.0 | 43 | 21 |
| Phenol | 38.25 | 438 | 160 | 33.0 | 43 | 23 |
| Phenol | 40 | 438 | 160 | 29.5 | 43 | 31.5 |
| Phenol | 4.0 | 478 | 160 | 32.0 | 33 | 3 |
| Phenol | 19.25 | 478 | 160 | 24.5 | 33 | 26 |
| Phenol | 36.25 | 478 | 160 | 20.5 | 33 | 38 |
| Phenol | 39.0 | 478 | 160 | 23.5 | 33 | 29 |
| Phenol | 40.0 | 478 | 160 | 17.0 | 33 | 48.5 |
| Toluene | 20.0 | 478 | 160 | 32.5 | 33 | 1.5 |

TABLE 1-continued

| Additive | Amount (Wt. %) | Contact Temp (°F.) | Contact Time (Min) | Product Coal Water (Wt. %) | Comparable Product Coal Water With No Additive (Wt. %) | Water Content Reduction (%) |
|---|---|---|---|---|---|---|
| Formaldehyde | 10.0 | 478 | 160 | 46.5 | 33 | −41 |
| Ammonia | 15.0 | 478 | 160 | 42.5 | 33 | −29 |
| Carbon dioxide | 26.75 | 478 | 160 | 41.0 | 33 | −24 |
| Phosphoric acid | 4.0 | 478 | 160 | 31.0 | 33 | 6 |
| Phosphoric acid | 20.0 | 478 | 160 | 25.0 | 33 | 24 |
| Phosphoric acid | 37.5 | 478 | 160 | 16.5 | 33 | 50 |
| Acetic acid | 20.0 | 478 | 160 | 24.0 | 33 | 27 |
| Oxalic acid | 20.0 | 478 | 160 | 21.0 | 33 | 36 |
| Hydrochloric acid | 17.0 | 478 | 160 | 14.0 | 33 | 57 |
| Pyridine | 20 | 478 | 160 | 30.0 | 33 | 9 |

The test results above clearly show that a significant improvement in the amount of bound water released at given temperature and pressure conditions is accomplished by the use of acidic materials in the contact zone.

Having thus described the invention I claim:

1. In a process for reducing the water content of coal containing bound water by releasing at least a portion of said bound water, said process consisting essentially of, treating said coal by maintaining said coal at a temperature from about 220° to about 500° F. in the presence of water at a pressure sufficient to maintain at least a portion of said water in a liquid phase for a treatment time sufficient to release at least a portion of said bound water, an improvement comprising: contacting said coal with an acidic material selected from the group consisting of carboxylic organic acids containing up to about 6 carbon atoms, phenol, phenolic acids, and inorganic acids during at least a portion of sait treatment time.

2. The process of claim 1 wherein said acidic material is selected from the group consisting of formic acid, acetic acid, oxalic acid and citric acid.

3. The process of claim 1 wherein said acidic material is phenol.

4. The process of claim 1 wherein said acid is selected from the group consisting of hydrochloric acid, sulfuric acid and phosphoric acid.

5. The process of claim 1 wherein said acidic material is present in an amount equal to at least about ten weight percent of the weight of said coal containing bound water.

6. A process for reducing the water content of coal containing bound water, said process consisting essentially of (a) Charging said coal to a contacting zone;

(b) Charging water to said contacting zone in an amount sufficient to produce a saturated steam environment in said contacting zone upon heating said coal in said first contacting zone;

(c) Charging an acidic material selected from the group consisting of carboxylic organic acids containing up to about 6 carbon atoms, phenol, phenolic acids and inorganic acids to said contacting zone;

(d) Heating said coal to a temperature from about 220° to about 500° F. at a pressure sufficient to maintain at least a portion of said water in a liquid phase; and, (e) Maintaining said coal in said contacting zone at said temperature and pressure for a time sufficient to release at least a portion of said bound water.

7. The process of claim 6 wherein said acidic material is selected from the group consisting of formic acid, acetic acid, oxalic acid and citric acid.

8. The process of claim 6 wherein said acidic material is phenol.

9. The process of claim 6 wherein said acidic material is hydrochloric acid, sulfuric acid or phosphoric acid.

10. The process of claim 6 wherein said acidic material is charged to said contacting zone in an amount equal to at least about ten weight percent of said coal containing bound water.

* * * * *